US011957961B1

(12) United States Patent
Li

(10) Patent No.: US 11,957,961 B1
(45) Date of Patent: Apr. 16, 2024

(54) TRAMPOLINE CONNECTOR THAT MAKES TRAMPOLINES MORE STABLE

(71) Applicant: Zhejiang Jidong Technology Co., Ltd, Zhejiang (CN)

(72) Inventor: Wenxing Li, Zhejiang (CN)

( * ) Notice: Subject to any disclaimer, the term of this patent is extended or adjusted under 35 U.S.C. 154(b) by 0 days.

(21) Appl. No.: 18/465,121

(22) Filed: Sep. 11, 2023

(51) Int. Cl.
*A63B 5/11* (2006.01)
*A63B 71/00* (2006.01)

(52) U.S. Cl.
CPC ..... *A63B 5/11* (2013.01); *A63B 71/0054* (2013.01)

(58) Field of Classification Search
CPC ..... A63B 5/11; A63B 71/0054; Y10T 403/44; Y10T 403/443; Y10T 403/4694; Y10T 403/7129; Y10T 403/7141; Y10T 403/7164; Y10T 403/7171; F16B 7/0433; F16B 7/0486; F16B 7/0493
See application file for complete search history.

(56) References Cited

U.S. PATENT DOCUMENTS

| | | | | |
|---|---|---|---|---|
| 9,689,519 | B2 * | 6/2017 | Hsiang | F16D 1/00 |
| 10,010,736 | B2 * | 7/2018 | Chen | A63B 5/11 |
| 10,549,136 | B2 * | 2/2020 | Hsiang | A63B 71/0054 |
| 10,799,743 | B2 * | 10/2020 | Zhu | A63B 5/11 |
| 11,583,717 | B1 * | 2/2023 | Zhu | A63B 71/022 |
| 2018/0093120 | A1 * | 4/2018 | Chen | A63B 5/11 |
| 2023/0078280 | A1 * | 3/2023 | Zhou | A63B 5/11 482/27 |

* cited by examiner

*Primary Examiner* — Megan Anderson
(74) *Attorney, Agent, or Firm* — Hawaii Patent Services; Nathaniel K. Fedde; Kenton N. Fedde

(57) ABSTRACT

Provided herein is a trampoline connector, comprising a transverse connection, a longitudinal connection, and connecting ring, wherein the transverse connection comprises a hollow body, the longitudinal connection comprises a fixing cavity, and the connecting ring comprises at least one connection ring opening and a through hole, wherein the transverse connection is vertically fixedly connected to the top of the longitudinal connection in a "T"-shaped structure, and the connecting ring is detachably connected to the outer wall of transverse connection.

20 Claims, 12 Drawing Sheets

TRAMPOLINE CONNECTOR THAT MAKES TRAMPOLINES MORE STABLE

TECHNICAL FIELD

The present invention relates to the technical field of a trampoline, in particular to a connecting member for a strong trampoline frame.

BACKGROUND

Trampolines on the market today consist of a trampoline mat, a frame, and connectors to connect the frame. Generally, through the connectors will be the frame of the guardrail, the ring tube and the support bar for connection, in through the bolt for fixation. However, the connectors on the market are prone to make the trampoline as a whole shake, resulting in poor firmness of the trampoline and inconvenient installation.

Chinese utility model patent CN203476952U disclosed a trampoline connector, the connectors by the horizontal tube and vertical tube composed of T-shaped tee tube, the wall of the horizontal tube is open on the horizontal positioning holes, the vertical positioning holes on the side wall of the aforementioned vertical tube, the T-shape tee tube through the mold molding for a one-piece structure. However, the hollow portion of the horizontal rod of the connecting member is used for the ring-shaped tube to pass through, and the hollow portion of the vertical rod of the connecting member is used for inserting and connecting the supporting feet, and such a setup causes the ring-shaped tube to sway in the space within the hollow state of the horizontal rod of the connecting member when people are located on the trampoline and jumping, so that the trampoline as a whole is shaken.

Publication No. U.S. Ser. No. 10/010,736B2 of the United States invention patent disclosure of a trampoline frame connectors, connectors are welded as a whole by the way of connection made, the frame through the way of insertion into the connectors, and there is no fixed device. Such a setting will still be used in the trampoline, the frame parts will be shaken in the gap of the connecting member, resulting in a poor solid effect of the trampoline, unstable;

Based on the above problems, it is necessary to propose a new trampoline frame of the connectors, the trampoline connector's simple structure, so that the overall connection is more solid, easy to disassemble, improve the stability and safety of the trampoline, trampoline use safety, convenient and solid and difficult to cause harm to the user, and further improve the sense of user experience.

SUMMARY

The present invention provides a trampoline connector that makes trampolines more stable, comprising a transverse connection, a longitudinal connection, and a connecting ring, characterized in that, said transverse connection comprises a hollow body, said hollow body having at least two connection holes opened on the outer wall of the hollow body, said connection holes being distributed on both sides of said hollow body;

said longitudinal connection comprises a fixing cavity, said fixing cavity having at least two fixing holes opened on the outer wall of the fixing cavity;

said connecting ring comprising at least one connection ring opening and through hole, said connection ring opening and through hole being of one-piece structure;

wherein said transverse connection is vertically fixedly connected above said longitudinal connection in a "T" structure, and said connecting ring is detachably connected to the outer wall of said transverse connection.

The present invention also provides a structurally stable trampoline comprising a trampoline assembly, an enclosure assembly and a connector, characterized in that, said trampoline assembly comprises a lower frame and a plurality of support feet uniformly distributed around said lower frame, the plurality of support feet being supportable for said trampoline assembly, wherein said lower frame has a closed geometry outline, said outline being provided with a center pad for a user to jump, and further comprising a periphery coupled to said center pad and a plurality of safety mats and flexible members removably attachable to said lower frame, wherein said safety mat is provided on said flexible members and forming a cover over said flexible members;

said enclosure assembly comprising a plurality of guardrail bars provided around said lower frame, and a guardrail mesh held in place by a plurality of said guardrail bars, wherein said guardrail mesh has an upper edge and a lower edge, said lower edge coupled to said periphery of said center pad, and said upper edge operatively secured to the top of said guardrail bar so as to cause said guardrail mesh to enclose said center pad and form a barrier to said center pad;

said connector, comprising a transverse connection, a longitudinal connection, and a connecting ring, wherein said transverse connection comprises a hollow body with a connection hole open on both sides of the outer wall of said hollow body, said connection hole being provided with first bolt; said longitudinal connection comprises a fixing cavity with at least two fixing holes open on the outer wall of said fixing cavity, said fixing holes being provided with second bolt; said connecting ring comprises at least one connection ring opening with through hole, said connection ring opening with through hole being of one-piece construction; wherein said transverse connection is vertically fixedly connected to said longitudinal connection in a "T" structure, and said connecting ring is detachably connected to the outer wall of said transverse connection;

wherein said connector is connected to said lower frame, said support feet and said guardrail bar, said lower frame being horizontally inserted through said transverse connection, said support feet being vertically fixed in said longitudinal connection and said connecting ring being used to fix said guardrail bar.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the drawings.

1000 transverse connection, 1100 hollow body, 1200 connection hole, 2000 longitudinal connection, 2100 fixing cavity, 2200 fixing hole, 3000 connecting ring, 3100 connection ring opening, 3200 through hole, 4000 lower frame, 4010 fixed buckle, 4100 safety mat, 4110 outside end, 4120 inside end, 4200 center pad, 4210 folding cavity, 4211 upper end, 4212 lower end, 4213 ring buckle, 4220 periphery, 5000 support foot, 6000 guardrail bar, 6100 guardrail mesh, 6200 flexible members, 6210 elastic department, 6220 first fastening par, 6230 second fastening part, 7000 trampoline assembly, 8000 enclosure assembly, 9000 connector.

DESCRIPTION OF EMBODIMENTS

In the following, the technical scheme in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

Figure 1:
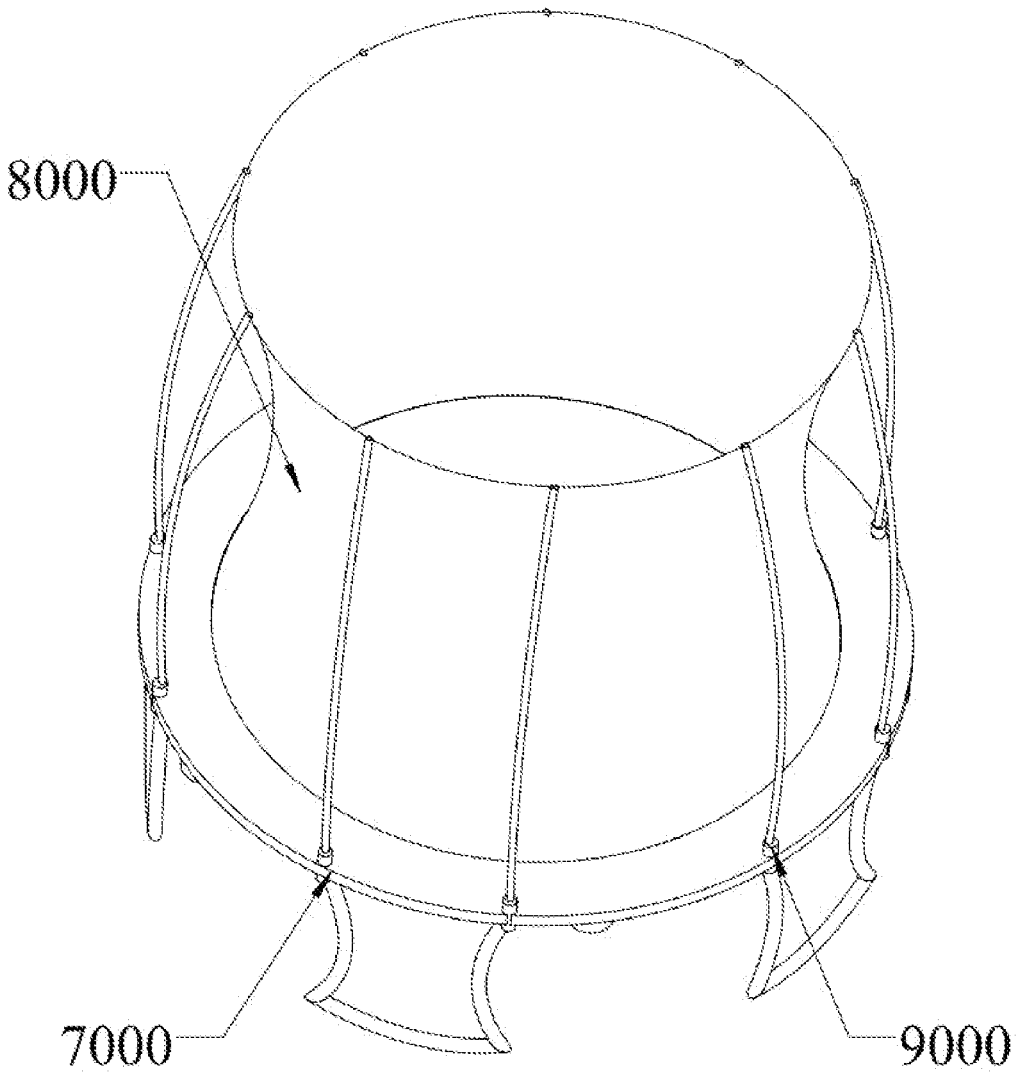
FIG. 1 shows a schematic diagram of the trampoline of the present invention application.
Figure 2:
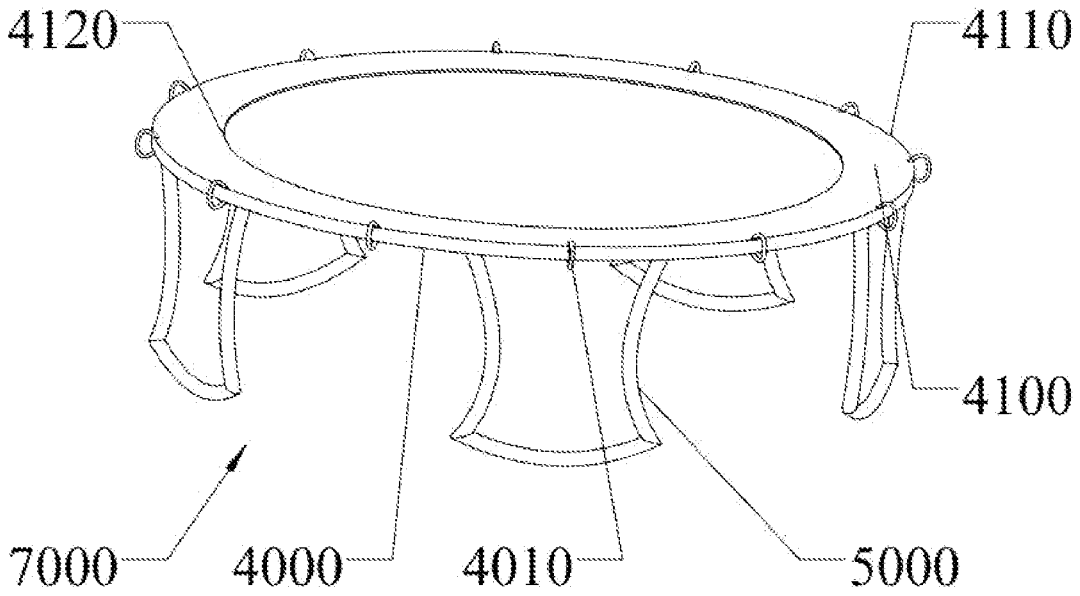
FIG. 2 shows a schematic diagram of the trampoline assembly of the present invention application.

Referring to FIG. 1 it is shown that the trampoline includes trampoline assembly 7000, enclosure assembly 8000 and connector 9000;

Referring to FIG. 2, trampoline assembly 7000 comprises a lower frame 4000 and a plurality of support feet 5000 evenly spaced around the lower frame 4000, the plurality of support feet 5000 being supportable against the trampoline assembly 7000, with one end of each of the support foot 5000 being connected to the connector 9000 so as to form a solid connection.

The lower frame 4000 has a closed geometrically shaped outer contour, the outer contour being in the form of a generally circular shape, and the lower frame 4000 is assembled from a plurality of arcuate edges, with one of the ends of two adjacent arcuate edges connected to each other, and all of the arcuate edges being connected in sequence to form a circular shape. Both lower frame 4000 and support foot 5000 are made of carbon fiber material and have a bending arc of 15° to 40°, with characteristics such as high strength and high elasticity, and in some embodiments, the material may be a plastic, or a ductile material such as a metallic material.

In some embodiments (not shown in the figures), the shape of the outer contour of lower frame 4000 may also be rectangular, or trapezoidal, or triangular, or elliptical, or fan-shaped, or bow-shaped, or other geometric shapes.

Figure 5:
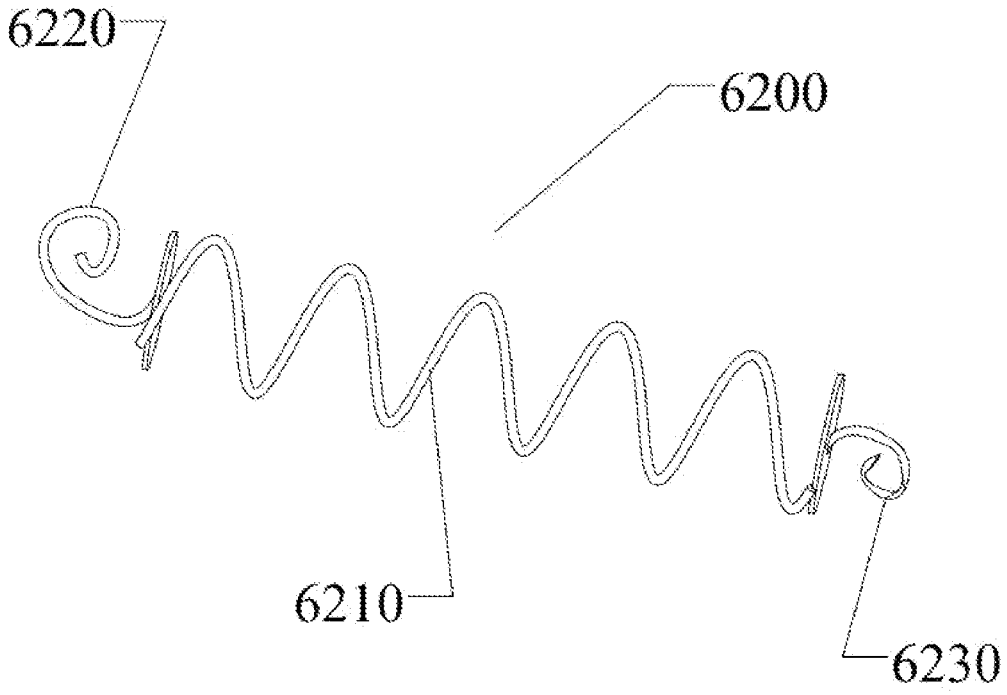
FIG. 5 shows a schematic diagram of the elastic member of the present invention application.

Center pad 4200 is placed within the outer contour of lower frame 4000, fixed buckle 4010 and ring buckle 4213 are located on lower frame 4000 and center pad 4200, respectively, and safety mat 4100 is attached outside of center pad 4200, safety mat 4100 has an outside end 4110 and an inside end 4120, center pad 4200 has a periphery 4220, and safety mat 4100 is provided above and forms a cover over flexible members 6200 of the trampoline so that a user will not be in danger of stepping on flexible members 6200 when jumping on trampoline assembly 7000;

Referring to FIG. 5, it is shown that in this embodiment flexible members 6200 is integrally molded and also includes elastic department 6210, with both first fastening par 6220 and second fastening part 6230 in the shape of a hook. In some embodiments, the fastening portion may also be in the shape of a button or the rest of the geometry that can be detachably attached.

In this embodiment (not shown in the figure), flexible members 6200 makes center pad 4200 and lower frame 4000 form a connection through the hook-shaped connection portion, which is hooked on ring buckle 4213 of center pad 4200 and fixed buckle 4010 of lower frame 4000, wherein first fastening par 6220 is hooked on ring buckle 4213 of center pad 4200 and second fastening part 6230 is hooked on fixed buckle 4010 of lower frame 4000, so as to make center pad 4200 highly elastic and to support the user to jump and bounce on the trampoline, and in some embodiments, the connecting means may be a snap connection, a Velcro connection means, or a glued connection way, or a zipper connection way and other remaining connection fixing ways.

Figure 3:
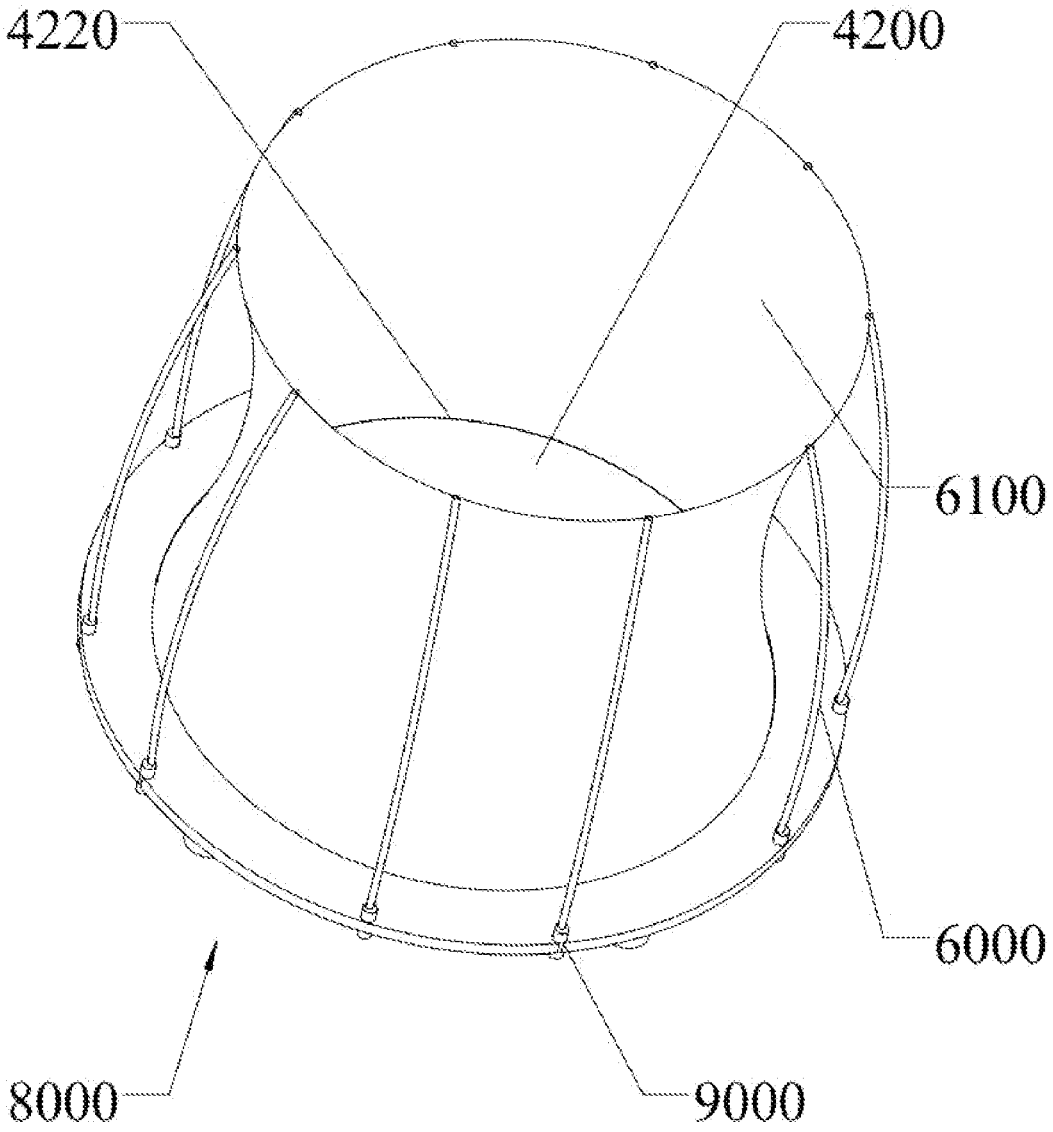
FIG. 3 shows a schematic diagram of the enclosure assembly of the present invention application.

Referring to FIG. 3, enclosure assembly 8000 includes a plurality of guardrail bars 6000 disposed around lower frame 4000, and guardrail mesh 6100 held in place by the plurality of guardrail bar 6000*s*, guardrail mesh 6100 having an upper edge and a lower edge, the lower edge coupled to the periphery 4220 of center pad 4200, and the upper edge operably secured to the top of guardrail bar 6000 to allow guardrail mesh 6100 to encircle center pad 4200 and form a barrier to center pad 4200, so that a user can be effectively blocked by guardrail mesh 6100 when jumping on center pad 4200;

In this embodiment, the lower edge of guardrail mesh 6100 is connected with center pad 4200 as a sewing connection. It is to be further explained that the connection method of guardrail mesh 6100 and center pad 4200 is not limited to the connection methods listed above, and the person skilled in the art may flexibly adjust and set the connection method of guardrail mesh 6100 and center pad 4200 in practical application, as long as it is possible to make center pad 4200 and guardrail mesh 6100 connected in a removable manner, such as the Velcro connection method, or the glued connection method, or the zipper connection method, or the buckle connection method, and other remaining the connection and fixing method.

Guardrail bar 6000 is made of a tough material and has a bending radius of 0° to 30°, without limitation in this embodiment, and the material may be plastic, or metal, or a tough material such as fiber.

Guardrail mesh 6100 has a zipper structure on the inner surface and the outer surface, so that when the user is using the trampoline for entertainment, the zipper can be zipped to form a protection to ensure that the user will not fall out of the trampoline during the process of using the trampoline, which improves the safety of the trampoline. Optionally, the zipper structure can also be replaced with the rest of the connection and fixing methods such as the Velcro connection method, or the glued connection method, or the buckle connection method.

The shape of the zipper of guardrail mesh 6100 is in the shape of "L" and this shape can make guardrail mesh 6100 collide with the user, and the zipper is not easy to be damaged in the shaking of guardrail mesh 6100 and is not easy to cause injury to the user, and in some embodiments, the shape of the zipper can also be other solid and stable and non-injurious character shapes.

Lower frame 4000, support foot 5000 and guardrail bar 6000 are provided with bolt holes, and the connection hole 1200 are used for fixing the connection with the bolts, so as to fix lower frame 4000, support foot 5000 and guardrail bar 6000 in the corresponding positions.

As a preferred embodiment of the present invention, in order to make the overall trampoline connection more solid, easy to disassemble, and improve the stability and safety of the trampoline, the present invention provides a trampoline connection member.

Figure 4:
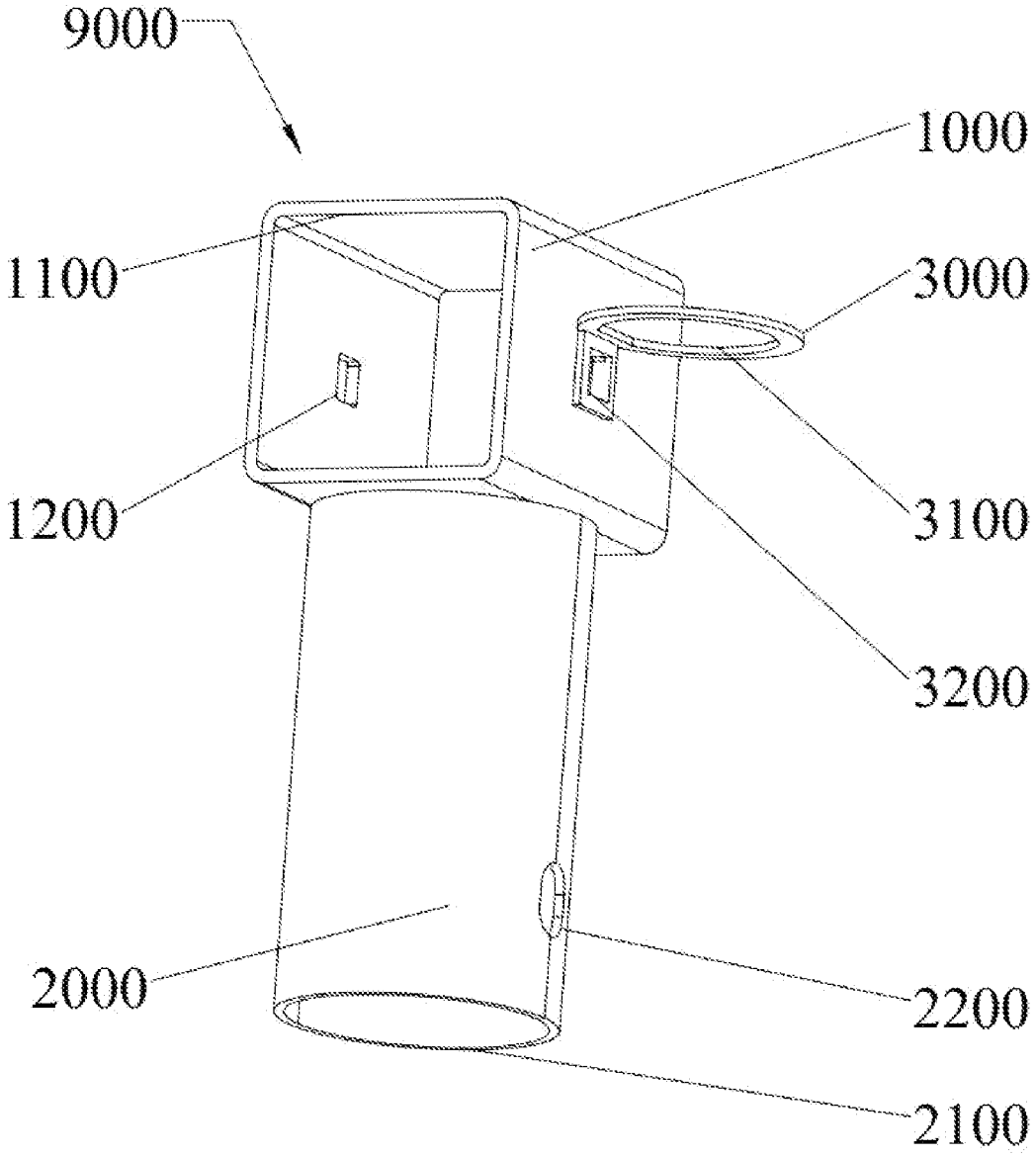
FIG. 4 shows a schematic diagram of the connection member of the present invention application.

As shown in FIG. 4, a trampoline connector 9000 includes transverse connection 1000, longitudinal connection 2000 fixedly connected to transverse connection 1000, and transverse connection 1000 and longitudinal connection 2000 are connected in a "T" shape, which makes the structure of connector 9000 more reasonable, and the force when connecting the trampoline is more uniform, as well as connecting ring 3000 which is detachably attached to transverse connection 1000.

Transverse connection 1000 and longitudinal connection 2000 are fixed by welding as a whole, in some embodiments, the connection can also be replaced by threaded connection, or key connection, or pin connection, or pipe connection and other connection and fixing methods, so as to make the main body structure of connector 9000 have enough stability, and the connection of the trampoline is not prone to shaking.

The interior of transverse connection 1000 is a hollow body 1100 in the shape of a square tube, which allows the lower frame 4000 of the trampoline to be inserted therein and fixedly connected, and the interior of longitudinal connection 2000 has a fixing cavity 2100 in the shape of a round tube with a hollow structure for the support foot 5000 of the trampoline to be fixed therein, and, preferably, the shapes of the transverse connection 1000 and the longitudinal connection 2000 may be manufactured to be a round tube, a square tube, a rectangular tube, and so on and so forth, and other various three-dimensional structures in planar form.

The surface of transverse connection 1000 has a connection hole 1200 on both sides, the connection hole 1200 runs through the surface of transverse connection 1000, connecting ring 3000 includes a connection ring opening 3100 and a through hole 3200, the connection ring opening 3100 is set close to the upper end 4211 of transverse connection 1000, the connection hole 1200 and the through hole 3200 are in contact with each other, and the two are in a concentric assembly state, and the bolted connection enables the connecting ring 3000 to be fixed to the outer shell of the transverse connection 1000 in a removable connection, which strengthens the firmness and stability of the trampoline.

The two sides connection hole 1200 and through hole 3200 are of equal size, the screws are inserted into transverse connection 1000 from the place where through hole 3200 is in contact with one side connection hole 1200, and are extended from the other end of connection hole 1200, and are fixed with bolts at the extended place, and the bolted connection ensures that connecting ring 3000 is not easy to loosen from transverse connection 1000, and that no large rotation can be generated for disassembly and replacement of parts.

Figure 6:
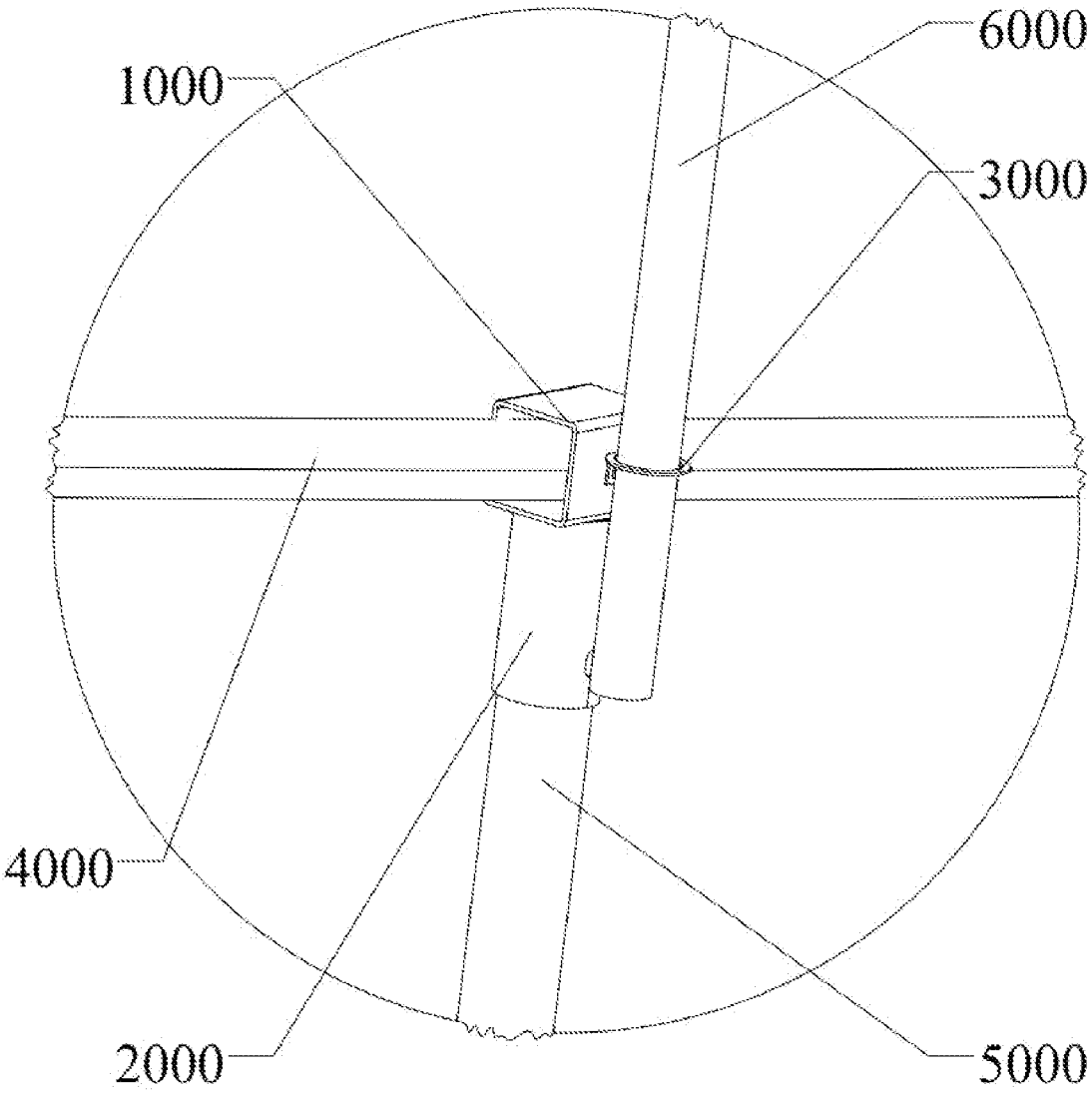
FIG. 6 shows a schematic diagram of the connection structure in the present invention application.

Specifically, referring to FIG. 6, the diameter of hollow body 1100 of transverse connection 1000 is larger than the diameter of lower frame 4000, and when lower frame 4000 is inserted in transverse connection 1000 for fixing, lower frame 4000 is inserted from one side of transverse connection 1000 through the whole of hollow body 1100, and protrudes out from the other side, and when lower frame 4000 is inserted in and fixed to transverse connection 1000, the end of the arc side is connected to the end of the other arc side, thus forming the whole of lower frame 4000. After completing the connection, lower frame 4000 is fixed through the connection hole 1200 of transverse connection 1000, using screws through the connection hole 1200, and the transverse connection 1000 and connecting ring 3000, and at the other end of the screw, a bolt is used for fixing, so that lower frame 4000 is fixed in the interior of transverse connection 1000 and connecting ring 3000 is fixed in the exterior wall of transverse connection 1000, lower frame 4000 is not prone to shaking, and connecting ring 3000 is not prone to rotating relative to each other, which strengthens the stability of the trampoline, and at the same time, the bolted connection is a removable link, which is convenient for the maintenance and repair and replacement of the parts in the future.

In some embodiments (not shown in the drawings), in order to better stabilize lower frame 4000 and insert hollow body 1100 so that it does not shake, hollow body 1100 has a certain curvature, with the curvature ranging from 0° to 30°, so as to make hollow body 1100 match the structural shape of lower frame 4000 and provide a stable fit.

It is to be further explained that the connection method of lower frame 4000, ring 3000 and transverse connection 1000 is not limited to the connection method listed above, and the person skilled in the art can flexibly adjust and set the connection method in practical application, as long as it is possible to make lower frame 4000, connecting ring 3000 and transverse connection 1000 to be connected in a removable manner, for example, a key connection, or a snap connection, or a pin connection, or a pipeline connection, and the rest of the connection and fixation methods.

The surface of longitudinal connection 2000 has a fixing hole 2200 on both sides, and the fixing hole 2200 runs through the surface of longitudinal connection 2000, and when the support foot 5000 is inserted into the fixing cavity 2100 of longitudinal connection 2000 and the guardrail bar 6000 passes through the connecting ring 3000 located in the longitudinal connection 2000, the support foot 5000 is fixed to the interior of longitudinal connection 2000 in a removable connection by a bolt connection and the guardrail bar 6000 is fixed to the outer side wall of longitudinal connection 2000 in a removable connection.

Fixing hole 2200 of longitudinal connection 2000 is opened in the same vertical direction as connection hole 1200 of transverse connection 1000 to facilitate installation and locking when the trampoline frame is attached. In some embodiments, the orientation of fixing hole 2200 and connection hole 1200 may also be inconsistent, as long as it allows for smooth installation and locking of the trampoline frame.

As support foot 5000 is inserted straight into longitudinal connection 2000, bearing most of the weight of the entire trampoline, if support foot 5000 and lower frame 4000 contact each other during the overall connection, support foot 5000 will distribute the weight in the form of extrusion to lower frame 4000, which will lead to deformation or even fracture of lower frame 4000, thereby causing the trampoline to produce a safety hazard. Therefore, in order to prevent contact between lower frame 4000 and support foot 5000, respectively, during the connection of the connection within the connection and fixation, the welding place of transverse connection 1000 and longitudinal connection 2000 is a closed state, and both of them are connected to the trampoline frame. Transverse connection 1000 and longitudinal connection 2000 welding for the closed state, the two do not communicate, and the welding part has a certain thickness, is not easy to be pierced, which can ensure that lower frame 4000 and support foot 5000 independent assembly, do not affect each other, improve the service life of the parts, consolidate the stability of the trampoline.

Referring to FIG. 6, specifically, when at the time when support foot 5000 is inserted into longitudinal connection 2000, the diameter of fixing cavity 2100 of longitudinal connection 2000 is larger than the diameter of support foot 5000, and support foot 5000 can be inserted all the way into the interior of longitudinal connection 2000 until support foot 5000 touches the weld, connection ring opening 3100 on connecting ring 3000 is used to fix guardrail bar 6000, which passes through connecting ring 3000 and is located at the outer side wall of longitudinal connection 2000, and connection ring opening 3100 and through hole 3200 are one-piece fixed connection. Subsequently through the screws from one side of Fixing hole 2200 into the other Fixing hole 2200 out, using the bolt to lock the screws, support foot 5000, guardrail bar 6000 and longitudinal connection 2000 are fixed, so that support foot 5000 is fixed in the interior of longitudinal connection 2000, guardrail bar 6000 is fixed in the outer wall of longitudinal connection 2000, so that support foot 5000 and guardrail bar 6000 are not prone to loosening and relative rotation, increasing the stability of the trampoline, and at the same time, the bolt connection is removable link, easy to later on meanwhile, the bolted connection is a removable link, which facilitates the maintenance, repair and replacement of the parts in the future.

It is to be further explained that the connection between support foot 5000, guardrail bar 6000 and longitudinal connection 2000 is not limited to the connection methods listed above, and the technicians in the field can flexibly adjust and set the connection methods in practical applications, as long as it is possible to make the connection between support foot 5000, guardrail bar 6000 and longitudinal connection 2000 in a removable manner, such as key connection, or snap connection, or pin connection, or pipeline connection, and other connection and fixing methods.

In this embodiment, the connection ring opening 3100 of connecting ring 3000 is an approximate circular shape, and in some embodiments, the connection ring opening 3100 of connecting ring 3000 may also be rectangular, or trapezoidal, or triangular, or elliptical, or fan-shaped, or bow-shaped, and other geometric shapes that can be restricted and fixed to guardrail bar 6000. Meanwhile, connection ring opening 3100 in this embodiment is oriented to be fixed upwardly, located above through hole 3200, and the overall shape is in the shape of "F", and furthermore, the orientation of connection ring opening 3100 of connecting ring 3000 may be changed to be fixed downwardly, in the shape of "L" or other orientations that can be fixed for the orientation of guardrail bar 6000.

Connector 9000 in this embodiment is stainless steel material, and has a certain thickness, in some embodiments, the material made of connector 9000 can be plastic material, or steel material, or alloy material, or other metal material, at the same time, transverse connection 1000 and longitudinal connection 2000 have sufficient thickness, so that the strength of the connection part is very good.

Figure 7:
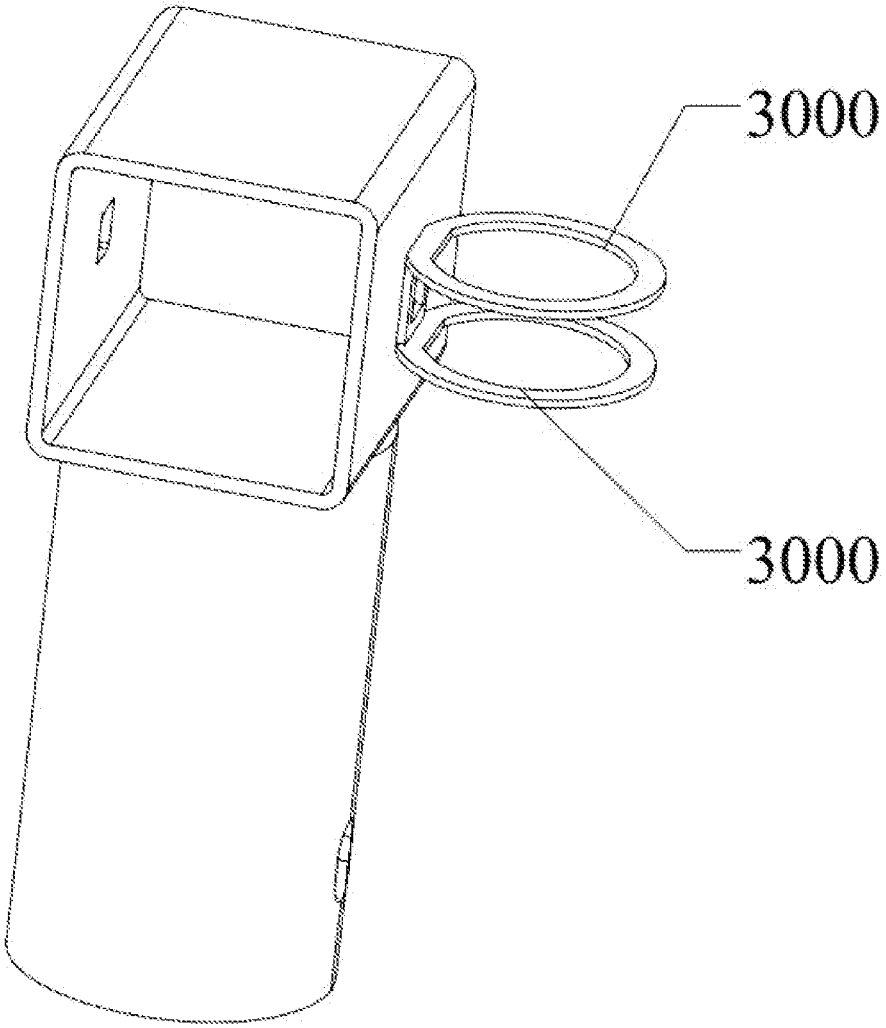
FIG. 7 shows a schematic diagram of the connection member extension in the present invention application.

Referring to FIG. 7, connecting ring 3000 can be set to include two connection ring openings 3100 and a through hole 3200, two connection ring opening 3100 were set in a symmetrical manner, the overall shape of connecting ring 3000 into a "⊏" shape, an axisymmetric shape, connection ring opening 3100 is set at the top and bottom ends of the through hole 3200, so as to increase the strength of the connecting ring3000, and in the guardrail bar 6000 for the insertion of the fixation of guardrail bar 6000 for the double limitation, in the original base of the connecting ring3000, the connection ring opening 3100 is set in the through hole 3200, so that the strength of the connecting ring 3000 is increased. The double restriction, on the original basis, further reduces the swaying and increases the solidity of guardrail bar 6000, thereby improving the stability of the trampoline.

Figure 8:
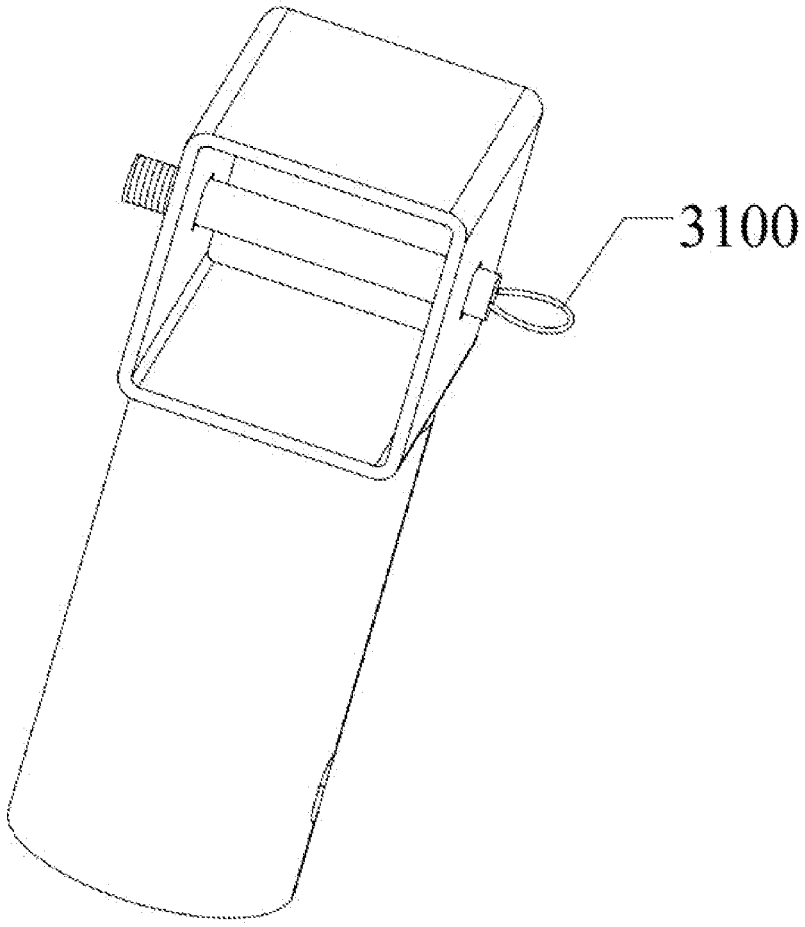
FIG. 8 shows a schematic diagram of the connection member extension in the present invention application.

Referring to FIG. 8, in some embodiments, connecting ring 3000 may be provided with only one connection ring opening 3100, which is fixedly connected to the top of the screw by a fixing method such as welding, and forms an integrated type with the screw, and optionally, the fixing connection method may also be a snap connection, or a screw connection and other fixing connection methods that are not prone to loosening. When the screw is inserted into transverse connection 1000 for fixing, connecting ring 3000 will also be fixed, which can reduce the number of parts and make the installation more convenient and faster, and the one-piece connection can also improve the strength of the parts and enhance the overall stability of the trampoline.

Figure 9:
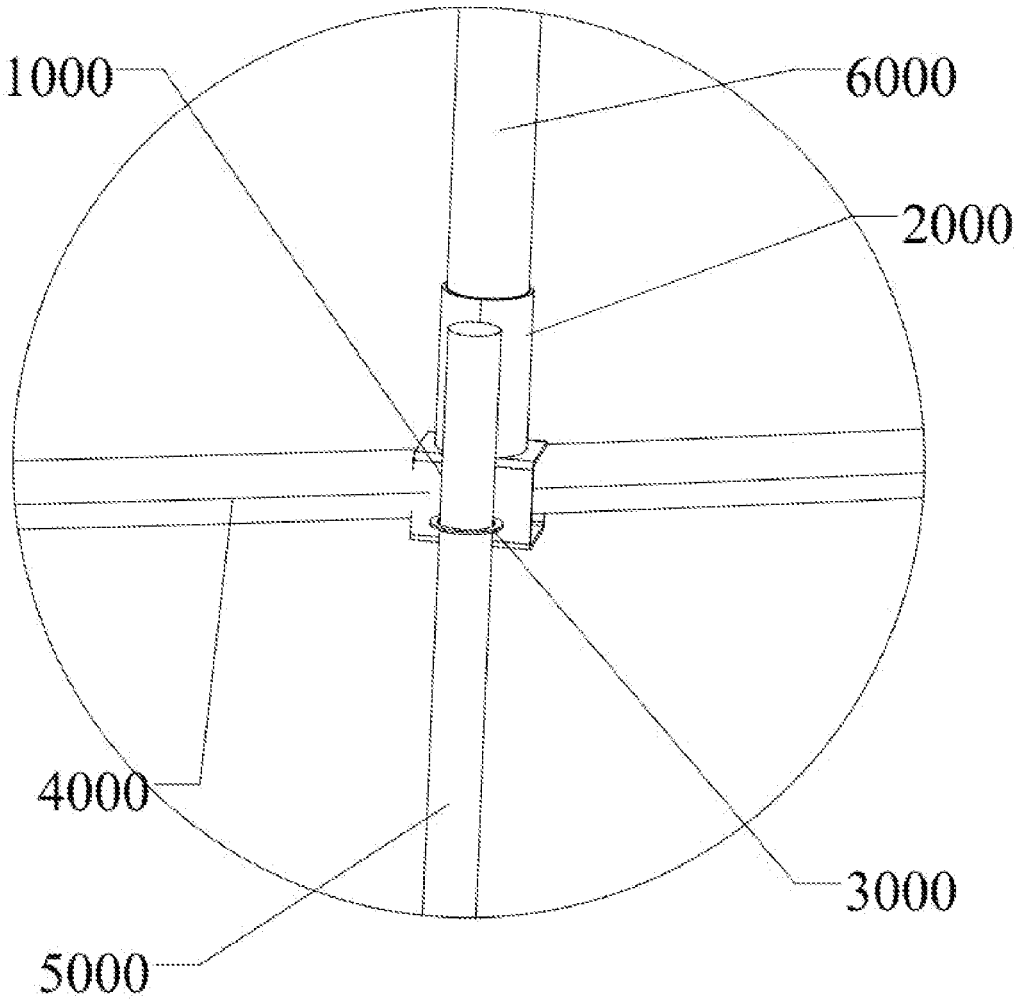
FIG. 9 shows a schematic diagram of another connection in the present invention application.

Referring to FIG. 9, in some embodiments, the whole of connector 9000 can be inverted to connect the trampoline, and the whole is placed in an inverted "T" shape, transverse connection 1000 is still used to fix lower frame 4000, and lower frame 4000 passes through hollow body 1100. Longitudinal connection 2000 is used to connect guardrail bar 6000, which is inserted inside longitudinal connection 2000, and connection ring opening 3100 on connecting ring 3000 is used to fix support foot 5000, which passes through connecting ring 3000 and is located on the outer wall of longitudinal connection 2000, and then support foot 5000, longitudinal connection 2000 and guardrail bar 6000 is detachably fixed by bolts.

Specifically, since the diameter of fixing cavity 2100 of longitudinal connection 2000 is larger than the diameter of guardrail bar 6000, when inserting guardrail bar 6000 into longitudinal connection 2000 at guardrail bar 6000, guardrail bar 6000 can be inserted all the way into the interior of longitudinal connection 2000 until guardrail bar 6000 touches the weld, connection ring opening 3100 on connecting ring 3000 is used to fix support foot 5000, which passes through connecting ring 3000 and is located in the outer wall of longitudinal connection 2000, and connection ring opening 3100 and through hole 3200 are one-piece fixed connection. Subsequently, through the screws from one side of fixing hole 2200 into the other fixing hole 2200 out, using the bolt to lock the screws, support foot 5000, guardrail bar 6000 and longitudinal connection 2000 are fixed, so that guardrail bar 6000 is fixed in the interior of longitudinal connection 2000, support foot 5000 is fixed in the outer wall of longitudinal connection 2000, which can make support foot 5000 and guardrail bar 6000 is not easy to produce loose and produce relative rotation, increasing the stability of the trampoline, at the same time, the bolt connection is removable links, easy to later the parts of the trampoline can be maintained, repaired, and replaced in the future.

As a preferred embodiment of the present invention, in order to reduce the risk of injury to the user, it is difficult for the trampoline to cause injury to the user's feet. The present invention also provides a folding and sewing method of the trampoline mat, which can further improve the safety performance of the trampoline, and can make the connection part of the trampoline mat more beautiful and improve the visual effect of the trampoline.

Figure 10:
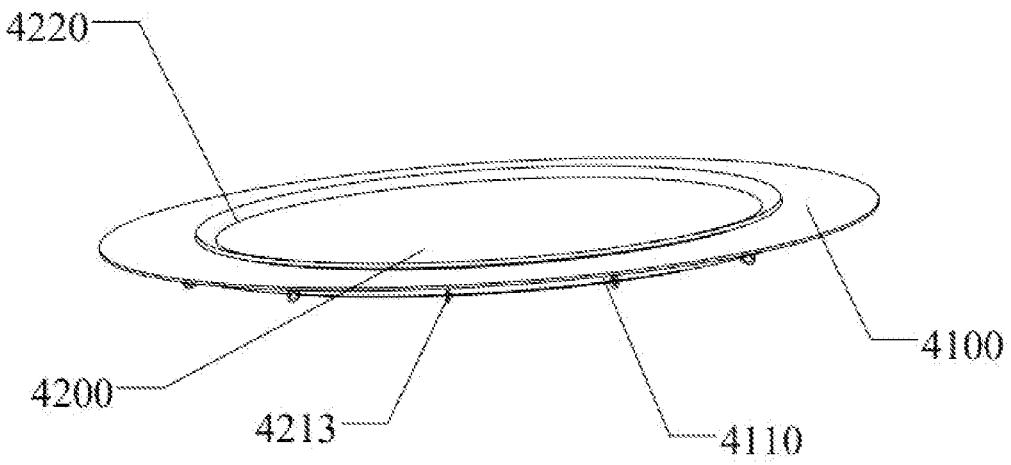
FIG. 10 shows a schematic diagram of a trampoline mattress in the present invention application.
Figure 11:
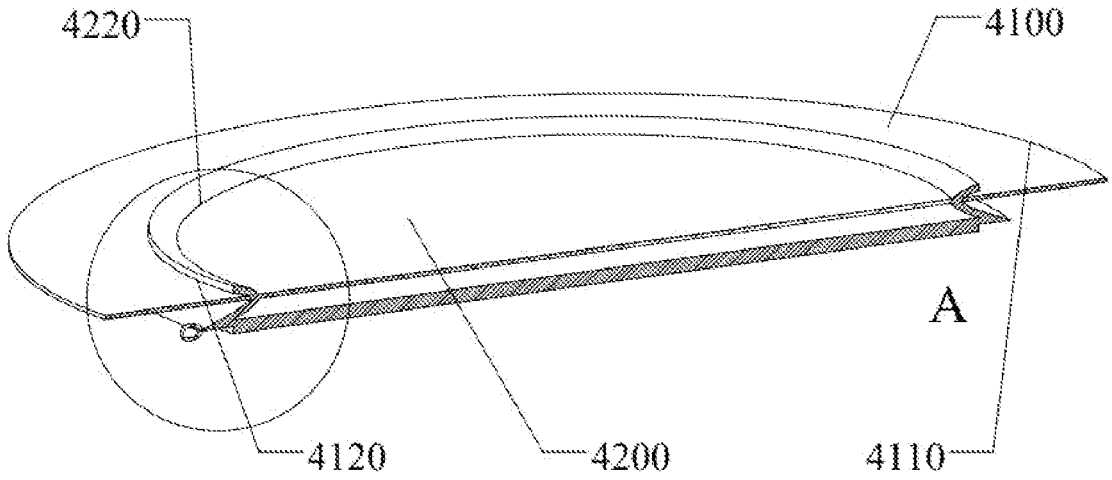
FIG. 11 shows a cross-sectional view of the trampoline mattress of the present invention application.
Figure 12:
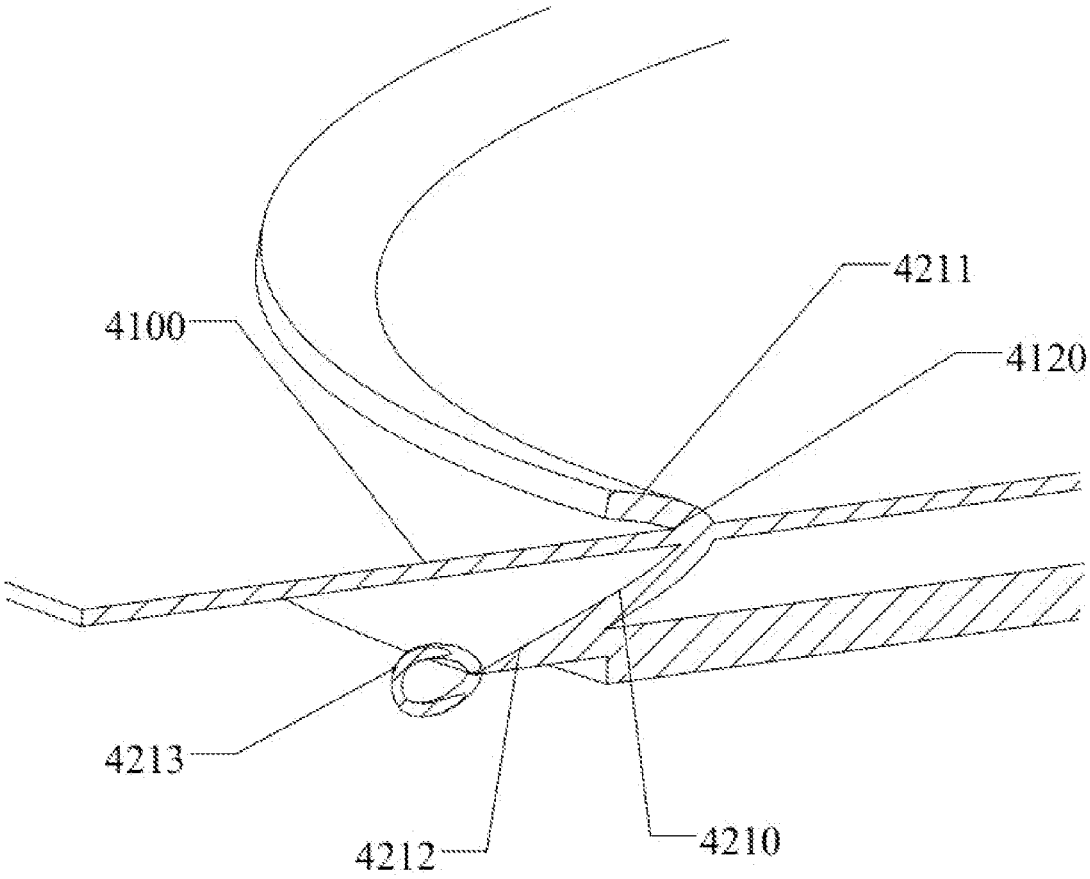
FIG. 12 shows a schematic view of the fold-over sewing of the present invention application.

Referring to FIG. 10 to FIG. 12, there is shown a folding and sewing method of a trampoline mattress, including center pad 4200, safety mat 4100 and a folding cavity 4210 formed by folding the outer ring of center pad 4200.

The inside end 4120 of the safety mat 4100 is connected to the periphery 4220 of the center pad 4200 by sewing, and the use of sewing makes the connection stronger, and makes the connection part more beautiful, improves the visual effect of the trampoline, and makes it more pleasing to the eye of the user, and, at the same time, reduces the use of connecting parts in the connecting process, and saves materials.

It is to be further explained that the connection method of center pad 4200 and safety mat 4100 is not limited to the connection methods listed above, and the technicians in the field may flexibly adjust and set the connection method of center pad 4200 and safety mat 4100 in practical application, as long as it is possible to make center pad 4200 and safety mat 4100 to be connected in a removable manner, such as the Velcro connection method, or the glued connection method, or the zipper connection method, or the buckle connection method, and other remaining connection and fixing method.

In this embodiment, safety mat 4100 wrapped around center pad 4200, safety mat 4100 of outside end 4110 through fixed buckle 4010 and lower frame 4000 for connection, safety mat 4100 has a certain thickness and made of PVC material, can play a non-slip, cushioning and other effects, with a certain thickness can make the user is not easy to touch the bottom of the trampoline components, in the case of a user fall, the user can play a protective role, safety mat 4100 material can be made of silicone, or EVA and other materials with a non-slip effect. The material of safety mat 4100 can be made of silicone, or EVA and other materials with anti-slip effect.

In this embodiment, center pad 4200 is a bouncing cloth made of a foam material with elasticity and a certain thickness for the user to bounce on center pad 4200, the surface of the trampoline is usually a closed and sealed bouncing cloth, and center pad 4200 can be made of a plastic mat, or a rubber mat, or a cotton and other materials that have a good elasticity and a cushioning effect.

The thickness of center pad 4200 is less than the thickness of safety mat 4100, safety mat 4100 needs to be thicker to provide safety and protection to the user, while center pad 4200 needs to be elastic, and if the thickness is too thick, it will lead to a loss of elasticity.

Referring to FIG. 11, periphery 4220 of center pad 4200 is folded inwardly to form folding cavity 4210, and folding cavity 4210 is disposed in the upper portion of center pad 4200 to facilitate the formation of a raised limiting portion, causing center pad 4200 to form a limited range of confined space, thereby limiting the user's foot, preventing the user's foot from slipping outwardly and thereby causing injury, and improving the safety of the trampoline in the process of use.

In this embodiment, the shape of the confined space of center pad 4200 and safety mat 4100 is a generally circular shape, and optionally, the shape of center pad 4200 and safety mat 4100 may also be in the shape of a rectangle, or a trapezoid, or a triangle, or an ellipse, or a fan, or a bow, and other planar geometric shapes.

Referring to FIG. 12, folding cavity 4210 is divided into upper end 4211 and lower end 4212, with the cavity connection ring opening 3100 facing outwardly from center pad 4200, and safety mat 4100 can be built into the cavity connection ring opening 3100 of folding cavity 4210 and connected and fixed to folding cavity 4210, and in this embodiment, folding cavity 4210 is in a reverse "Z" or "S" shape, so that inside end 4120 of safety mat 4100 can be more stably wrapped and fixed inside of folding cavity 4210. in this embodiment, folding cavity 4210 has a reverse "Z" or "S" shape, which allows inside end 4120 of safety mat 4100 to be more stably encased and secured within folding cavity 4210, and in some embodiments, folding cavity 4210 may be shaped in the form of a "C" shape, or a "<" shape, or other letters or numbers or symbols that may have a space to accommodate the safety mat 4100.

In this embodiment, the formation of folding cavity 4210 is characterized by convenience and simplicity. When the trampoline is folded and connected, periphery 4220 of center pad 4200 is folded towards the center of center pad 4200, and the folded shape is in a reverse "Z" or "S" shape, with the direction of periphery 4220 remaining unchanged, so as to form folding cavity 4210 with a cavity connection ring opening 3100 facing outwardly from center pad 4200, and the folded folding cavity 4210 has upper end 4211 and lower end 4212, and thus folding cavity 4210 has the shape of upper end 4211 and lower end 4212, and thus folding cavity 4210 has the shape of upper end 4211 and lower end 4212, and thus folding cavity 4210 has the shape of upper end 4211 and lower end 4212. The folding cavity 4210 obtained after folding has upper end 4211 and lower end 4212, whereby inside end 4120 of safety mat 4100 can be wrapped therein for sewing connection, thereby creating a fixation.

Specifically, it is first necessary to fold periphery 4220 of center pad 4200 inwardly, with the folding direction toward the interior of center pad 4200, so that a layer of cavity can be formed, and the folded shape at this time is an inverse "C" shape, and then, periphery 4220, which has been folded once, is folded again, with the folding direction in the opposite direction to that of the interior of center pad 4200, and folding cavity 4210, which has an inverse "Z"-type or "S"-shaped structure, is thus obtained, and as a result of folding twice, folding cavity 4210 has upper end 4211 and lower end 4212. Folding cavity 4210 has an inverse "Z" or "S" shape, and because it has been folded twice, folding cavity 4210 has upper end 4211 and lower end 4212, where the second folding distance is shorter than the first folding distance, making lower end 4212 longer than upper end 4211, and lower end 4212 has a protruding portion. Inside end 4120 of safety mat 4100 is set in folding cavity 4210, and upper end 4211 of folding cavity 4210 and inside end 4120 of safety mat 4100 are in contact with each other and are connected and fixed by means of sewing, so that inside end 4120 is fixed in folding cavity 4210, and outside end 4110 of safety mat 4100 is connected to lower frame 4000 by means of fixed buckle 4010, so that safety mat 4100 is completely fixed. After completing the connection fixing, there is no gap between center pad 4200 and safety mat 4100, and there is no gap between center pad 4200 and safety mat 4100, and the sewing portion will form a raised limiting portion at the edge of safety mat 4100, so that center pad 4200 forms a confined limiting circle with a limited range, so that when the user's foot slides outwardly, it will be blocked by the limiting portion and not be able to continue to slide outwardly, and will not fall into the gap between center pad 4200 and safety mat 4100, so that the user's foot will not fall into the gap between center pad 4200 and safety mat 4100 from the it will not fall into the gap between center pad 4200 and safety mat 4100, avoiding the possibility of users' feet coming out of the gap between center pad 4200 and safety mat 4100 and bumping against flexible members 6200 at the bottom of the trampoline, thus improving the safety of the trampoline.

After folding, lower end 4212 of folding cavity 4210 has a protruding portion, and preferably, in this embodiment, the protruding portion of lower end 4212 can be used to set ring buckle 4213 of center pad 4200 for connecting a spring component that provides elasticity for the trampoline, thereby saving the overall space of the trampoline.

In summary, the present invention application provides a connecting member of a trampoline frame and a folding and sewing method of a center mat and a safety mat 4100, which has a simple structure, can save a large amount of manpower and material resources, makes the trampoline safe to use, is convenient and firm, improves the stability of the trampoline, reduces the risk of injuries, and improves the visual effect of the trampoline.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A trampoline connector that makes trampolines more stable, the trampoline connector comprising:

a transverse connection, a longitudinal connection, and a connecting ring;

said transverse connection comprising a hollow body, said hollow body having an outer wall and at least two connection holes opened on the outer wall of said hollow body, said at least two connection holes being distributed on both sides of said hollow body;

said longitudinal connection comprising a fixing cavity, said fixing cavity having at least two fixing holes opened on an outer wall of said fixing cavity;

said connecting ring comprising at least one connection ring opening and a through hole, said connection ring opening and said through hole being of one-piece structure;

wherein said transverse connection is vertically fixedly connected above said longitudinal connection in a "T" structure, and said connecting ring is detachably connected to the outer wall of said hollow body.

2. The trampoline connector according to claim 1, wherein said connecting ring is in the shape of "T" and said connection ring opening is located above said through hole.

3. The trampoline connector according to claim 2, wherein said through hole and one of said at least two connection holes are concentrically assembled and in contact with each other, and said one of said at least two connection holes is set in the same vertical line as said one of said fixing holes.

4. The trampoline connector according to claim 3, wherein said connection hole is provided with a first bolt, said first bolt running through said one of said at least two connection holes and said through hole, so that said transverse connection forms a detachable connection with said connecting ring.

5. The trampoline connector according to claim 4, wherein said one of said fixing holes is provided with a second bolt, said second bolt running through said one of said fixing holes so that the connection is connected and fixed to said longitudinal connection.

6. The trampoline connector according to claim 5, wherein said outer wall of the hollow body and said outer wall of the fixing cavity possess a certain thickness and are both made of stainless-steel material.

7. The trampoline connector according to claim 1, wherein said transverse connection is shaped in the form of a square tube, and said hollow body is a square hollow structure and has a bending arc from 0° to 30°.

8. The trampoline connector according to claim 7, wherein said transverse connection and said longitudinal connection are of one-piece structure, and said transverse connection and said longitudinal connection are not connected internally.

9. The trampoline connector according to claim 1, wherein said longitudinal connection is shaped in the form of a circular tube and the fixing cavity of said longitudinal connection is a circular hollow structure.

10. A structurally stable trampoline comprising a trampoline assembly, an enclosure assembly and a connector, wherein said trampoline assembly comprises a lower frame and a plurality of support feet uniformly distributed around said lower frame, the plurality of support feet being supportable for said trampoline assembly, wherein said lower frame has a closed geometry outline, said closed geometry outline being provided with a center pad for a user to jump, and further comprising a periphery coupled to said center pad and a safety mat and a plurality of flexible members removably attachable to said lower frame, wherein said safety mat is provided on said plurality of flexible members and forming a cover over said plurality of flexible members;

said enclosure assembly comprising a plurality of guardrail bars provided around said lower frame, and a guardrail mesh held in place by the plurality of said guardrail bars, wherein said guardrail mesh has an upper edge and a lower edge, said lower edge coupled to said periphery of said center pad, and said upper edge operatively secured to the top of said plurality of guardrail bars so as to cause said guardrail mesh to enclose said center pad and form a barrier to said center pad;

said connector comprising a transverse connection, a longitudinal connection and a connecting ring, wherein said transverse connection comprises a hollow body with a connection hole open on both sides of an outer wall of said hollow body, said connection hole being provided with a first bolt; said longitudinal connection comprises a fixing cavity with at least two fixing holes open on an outer wall of said fixing cavity, said at least two fixing holes being provided with a second bolt; said connecting ring comprising at least one connection ring opening with through hole, said connection ring opening with through hole being of one-piece construction; wherein said transverse connection is vertically fixedly connected to said longitudinal connection in a "T" structure, and said connecting ring is detachably connected to an outer wall of said transverse connection;

wherein said connector is connected to said lower frame, said plurality of support feet and said plurality of guardrail bars, said lower frame being horizontally inserted through said transverse connection, said plurality of support feet being vertically fixed in said longitudinal connection and said connecting ring being used to fix said guardrail bar.

11. The structurally stable trampoline according to claim 10, wherein said guardrail mesh has an inner surface and an outer surface which are provided with a zipper structure, said zipper structure having an "L" shape.

12. The structurally stable trampoline according to claim 11, wherein said lower frame is assembled from a plurality of rounded edges, wherein one of said plurality of rounded edges is connected to a different one of said plurality of rounded edges at both ends, and wherein all of said plurality of rounded edges are connected in sequence to form a circular shape.

13. The structurally stable trampoline according to claim 12, wherein said hollow body of said transverse connection has dimensions not smaller than the dimensions of said lower frame, and wherein said one of said plurality of rounded edges of said lower frame passes through said hollow body.

14. The structurally stable trampoline according to claim 13, wherein each of said plurality rounded edges of said lower frame is provided with two symmetrical first round holes, said two symmetrical first round holes holes being configured to be passed through by said first bolt, securing said lower frame in said transverse connection.

15. The structurally stable trampoline according to claim 14, wherein said fixing cavity of said longitudinal connection has a diameter not less than the diameter of said plurality of support feet, said plurality of support feet being interposed and fixed inside said fixing cavity.

16. The structurally stable trampoline according to claim 15, wherein each of said plurality of support feet comprises two second round holes, said two second round holes being symmetrical respectively, said second two round holes being in the same horizontal position as said fixing hole, said two second round holes being configured to be passed through by said second bolt so that said plurality of support feet are fixedly connected in said fixing cavity.

17. The structurally stable trampoline according to claim 16, wherein each of said plurality of guardrail bars is provided with two third round holes symmetrically, said third round holes being configured to be passed through by said second bolt, securing said each of the plurality of guardrail bars to said longitudinal connection outer wall.

18. The structurally stable trampoline according to claim 17, wherein said connecting ring is socketed to the outside of said guardrail bar, said guardrail bar extending all the way down through said connecting ring until said third round hole is at the same level as said fixing hole.

19. The structurally stable trampoline according to claim 18, wherein said plurality of guardrail bars is made of a material having a toughness and having a bending arc from 0° to 30°.

20. The structurally stable trampoline according to claim 19, wherein said lower frame and said support foot are made of carbon fiber material and have a bending arc of 15° to 40°.

* * * * *